US006971511B2

(12) United States Patent
Holmon

(10) Patent No.: US 6,971,511 B2
(45) Date of Patent: Dec. 6, 2005

(54) PACKAGING CONTAINER FOR CANDLES AND INFORMATIONAL LITERATURE

(76) Inventor: David L. Holmon, 9691 Huron Dr., St. Louis, MO (US) 63132

( * ) Notice: Subject to any disclaimer, the term of this patent is extended or adjusted under 35 U.S.C. 154(b) by 106 days.

(21) Appl. No.: 10/249,740

(22) Filed: May 5, 2003

(65) Prior Publication Data

US 2004/0222110 A1 Nov. 11, 2004

(51) Int. Cl.[7] ..... B65D 77/00; B65D 25/04

(52) U.S. Cl. ..... 206/232; 206/446; 229/120.11; 229/120.18; 229/120.37

(58) Field of Search ..... 206/232, 446; 229/120.08, 120.11, 120.18, 120.37

(56) References Cited

U.S. PATENT DOCUMENTS 1,634,064 A * 6/1927 Ahlquist ..... 229/67.3
1,806,149 A * 5/1931 Daugherty ..... 239/57
2,015,278 A * 9/1935 Meyer ..... 229/120.18
2,359,679 A * 10/1944 Roehrl ..... 229/152
3,147,856 A * 9/1964 Lightner et al. ..... 206/232
3,853,259 A * 12/1974 Tupper ..... 229/103
4,700,831 A * 10/1987 Kassai ..... 206/232
6,533,117 B2 * 3/2003 Lundstrom et al. ..... 206/446

* cited by examiner

*Primary Examiner*—Bryon P. Gehman
(74) *Attorney, Agent, or Firm*—Blackwell Sanders Peper Martin LLP

(57) ABSTRACT

A display and storage container formed from a substantially flat sheet of board-type material which is foldable into a packaging container having an interior space which is sized and dimensioned to receive a particular product when positioned therewithin and further including a pocket or cavity formed adjacent one of the side walls associated with the packaging container. The top wall portion of the present container likewise includes an opening for allowing a person to smell the scent or fragrance associated with a scented product positioned within the container.

2 Claims, 4 Drawing Sheets

PACKAGING CONTAINER FOR CANDLES AND INFORMATIONAL LITERATURE

BACKGROUND OF INVENTION

The present invention relates generally to a display and storage container for use in storing and merchandising a wide variety of products in a retail setting and, more particularly, to a foldable board structure adapted to be configured into a display and storage container or box-like structure for holding scented products such as candles and the like as well as associated literature. The present device is also ideally suited for merchandising a wide variety of other products that have associated therewith informational or promotional literature that must be conveniently stored and displayed with the product.

For many years, marketing professionals have identified the importance of using point-of-purchase marketing techniques to increase the sales of a product. Any element of product design, packaging or other features can be used by marketers to improve a product's reception by customers at the point of sale. Providing entertaining, promotional and/or informative literature to the purchaser is one way of increasing a product's appeal. Generally, however, the packaging of a product is such that only a limited amount of information can be provided to a customer on the exterior of the packaging container unless an insert is enclosed within the product packaging itself. This has only limited value in point-of-sale marketing because the insert or other promotional literature is contained within the closed product packaging and is not seen until after the purchase, if any, is made. Thus there is a need for packaging containers that allow the inclusion of marketing or other literature in such a manner that such literature may be viewed by the consumer prior to purchase.

Some products also present unique difficulties to the marketing professional. Scented candles, for instance, sell largely due to the aesthetic and olfactory appeal of the product. In other words, the coloration of the candle and perhaps, more importantly, its smell or fragrance is what makes the product appealing to a potential purchaser. Traditional packaging is problematic when it comes to such products because the packaging may obscure the odor or fragrance of the product or, more importantly, prevent the scent of the product from reaching the consumer. Since consumers are unlikely to open a package prior to purchasing a product, a major tool for marketing scented products such as candles is lost unless the marketer foregoes packaging entirely. Thus, there is also a need for packaging containers which are adapted specifically for merchandising candles or other scented products to consumers that allow a purchaser at the point-of-sale to view and smell the product without having to open the packaging in order to do so.

Finally, packaging containers can often be bulky; they can take up valuable storage space; and they can lead to shipping difficulties prior to use. It is therefore also desirable that the packaging containers described above be formable from a flat sheet of material prior to use so that they can be easily transported in bulk from one location to another and can be stored in a minimum of space.

Accordingly, the present invention is directed to overcoming one or more of the problems as set forth above.

SUMMARY OF INVENTION

The present invention teaches the construction and use of a relatively simple and economical packaging container which is easily assembled and is specifically designed to hold candle products, although a wide variety of other products can likewise be packaged and housed within the present container. More particularly, the present container includes a substantially flat sheet of board-type material which, when assembled, forms an attractive packaging container having a pocket or cavity associated therewith adaptable for receiving and holding product literature or other informational literature associated with the product stored within the container. In the case of candle products, the present container also includes an opening associated with the top portion of the container through which a potential customer can have access to and smell the candle product stored therewithin. The substantially flat sheet of board material is scored or otherwise bendable or foldable at various intermediate locations therealong such that the flat sheet of board material can be formed into a box-like container which is sized and dimensioned so as to substantially conform to the shape of the particular product which will be positioned therewithin. When formed into the present container, various portions of the substantially flat sheet of board material are attached by suitable attachment means as will be hereinafter explained, the end result being a box-like container having a pocket or cavity formed adjacent one side portion thereof adaptable for receiving promotional or other type literature.

The flat sheet member forming the present container includes a plurality of panels defined by the various score or fold lines, some panels being of greater width as compared to other panels such that when the flat sheet member is folded in a particular manner, the pocket or cavity associated with one side portion thereof is formed. The substantially flat sheet member likewise includes a plurality of flap members associated with various panel portions, these flap members being positioned and located to form the top and bottom surfaces of the present container.

In use, the present packaging container provides simple and efficient means for effectively displaying and merchandising scented products such as candles as well as a wide variety of other products to consumers. Because the present packaging container is formed from a substantially flat sheet of board material, it can be easily stored and transported, prior to use, in a minimum of space. Appropriate advertising and other indicia can likewise be stenciled or otherwise applied to the outer surface of the substantially flat sheet of board material to appropriately advertise the product merchandised within the assembled package container.

BRIEF DESCRIPTION OF DRAWINGS

These and other inventive features and advantages will be apparent from the following detailed description when considered in connection with the accompanying drawings in which similar reference characters denote similar elements throughout the several views.

DETAILED DESCRIPTION

Figure 1:
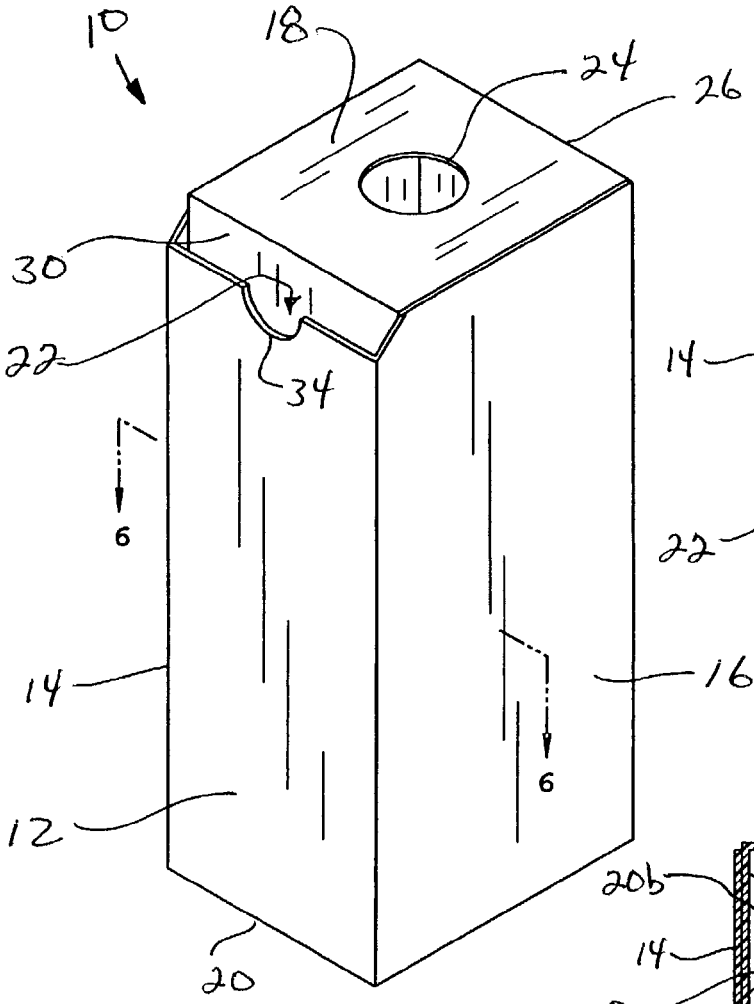
FIG. 1 is a perspective view of one embodiment of a container constructed in accordance with the teachings of the present invention.
Figure 2:
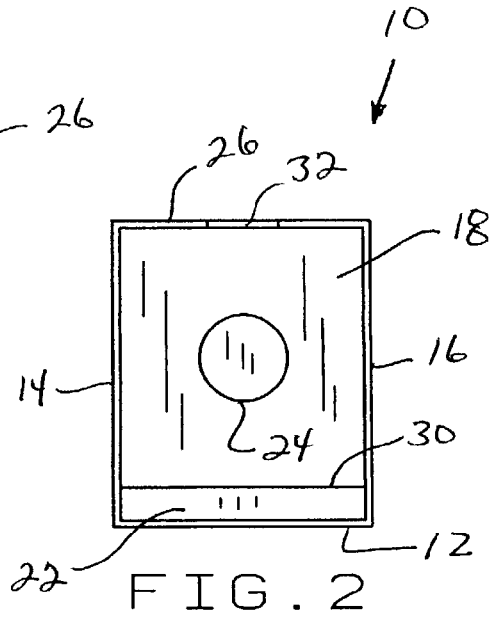
FIG. 2 is a top plan view of the container embodiment illustrated in FIG. 1.
Figure 6:
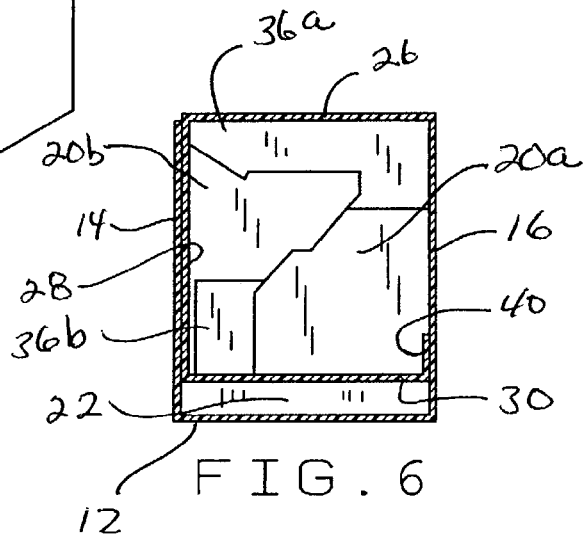
FIG. 6 is a cross sectional view taken along lines 6—6 of FIG. 1.
Figure 3:
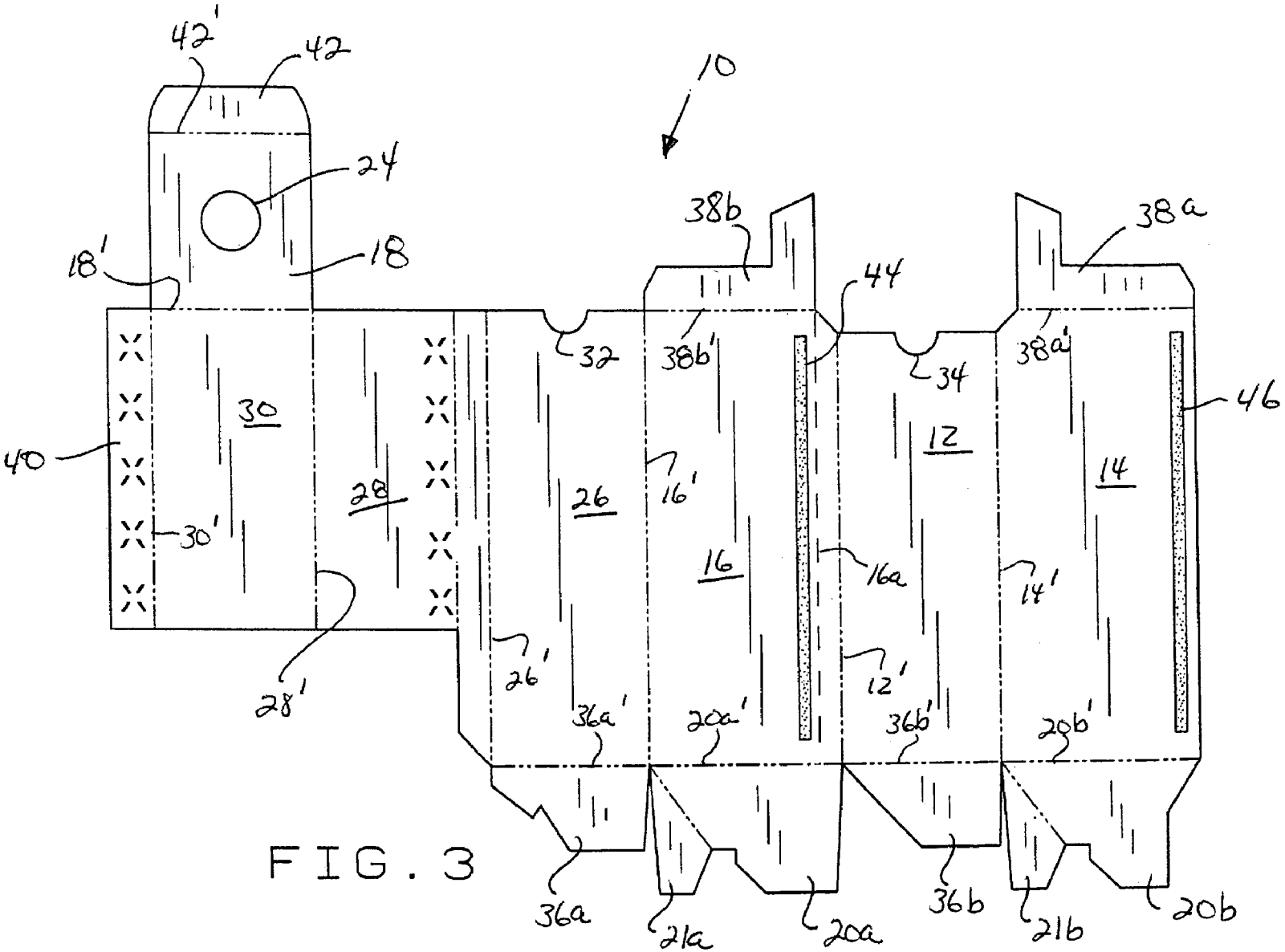
FIG. 3 is a plan view of a substantially flat sheet of material which is used to form the container embodiment of FIGS. 1 and 2, the present container being shown in its unfolded configuration.

Referring to the drawings more particularly by reference numbers wherein like numerals refer to like parts, number 10 in FIG. 1 identifies one embodiment of the present display and storage container which includes a front panel or surface 12, opposing side panels or surfaces 14 and 16, top panel or surface 18, bottom panel or surface 20, rear panel or surface 21, and a pocket or cavity 22. The pocket 22 is formed by front panel 12 and panel 30 positioned in spaced relationship therebehind. In one embodiment of the present invention, a top edge of front panel 12 includes a semi-circular cutout 34 so that a consumer can easily grasp and remove a booklet or other product literature or promotional material stored within the pocket 22. As best seen in FIG. 2, top panel 18 has an opening 24 located therein for allowing a customer to smell the scented candle or other product housed within the container 10. The rear panel 26 may likewise include a cutout 32 as best shown in FIG. 3 for allowing a consumer to easily grasp and open the top panel or lid 18 to remove the product stored within container 10. In this regard, top panel 18 is movable between an open position providing access to the interior space of the container and a closed position denying access thereto.

Referring to FIG. 3, the packaging container 10 is shown in its initial flat form as a sheet of board-type material which is scored or otherwise bendable or foldable to define, in the embodiment shown, six separate foldable panels 12, 14, 16, 26, 28 and 30. The visible surface of the container shown in FIG. 3 will be referred to as the inner surface, while the surface not visible will be referred to as the outer surface. The respective panels are defined by score lines, fold lines or other weakening means 12', 14', 16', 26', 28' and 30' positioned on at least the inner surface of sheet 10. The sheet 10 also includes a top panel 18 defined by fold line or other weakening means 18', and bottom flaps 20*a* and 20*b* defined by fold lines or other weakening means 20*a*' and 20*b*' respectively, the flaps 20*a* and 20*b* combining to form bottom panel 20. Stemming from the bottom edges of panels 12 and 26, and defined by fold lines or other weakening means 36*b*' and 36*a*' respectively, are additional flaps 36*b* and 36*a* which, when sheet 10 is folded into its product container configuration, such additional flaps fold inside of flaps 20*a* and 20*b* and engage therewith to likewise form bottom panel 20. Flaps 36*a* and 36*b* likewise provide additional support, strength and stability to bottom panel 20.

Panels 14 and 16 likewise include flaps 38*a* and 38*b* stemming from the top edges thereof, these flaps being defined by fold lines or other weakening means 38*a*' and 38*b*' respectively. End panel 30 also includes a foldable tab portion 40 defined by fold line or other weakening means 30' which will be attachable to panel 16 along dished-line 16*a* as will be hereinafter explained. Tab 40 serves to help maintain the container 10 in its folded, assembled configuration. Top panel 18 also includes a foldable tab 42 defined by fold line or other weakening means 42' which is insertable into the interior of the container 10, when assembled, adjacent the rear panel 26 and serves to hold the top panel 18 in its closed position as illustrated in FIG. 1. Panels 12 and 26 also include cutouts 34 and 32 respectively as previously explained to facilitate the removal of the product literature positioned within pocket 22 and opening of the top panel 18 for access to the product positioned within container 10.

Although the initial flat form of the present container 10 has been shown in FIG. 3 and described above, the present invention is not limited to the specific shape and size so illustrated and described. Thus, in order to accommodate different sized and shaped products, containers 10 formed of board-type sheets as illustrated in FIG. 3 can be produced in a variety of shapes with attendant variations in the number, size and shape of the various panels, flaps and tabs associated with a particular container. Thus, there can conveniently be produced many different types of containers with wide variation in the longitudinal and lateral dimensions thereof, including variations in the overall shape such as rectangular, square, circular, triangular, octagonal and still other shapes. Likewise, all of the panels, flaps and tabs associated with a particular packaging container constructed in accordance with the teachings of the present invention would be defined in a similar manner by fold lines or other weakening means as described above with respect to FIG. 3, but such fold lines or other weakening means could be present in greater or lesser numbers and such fold lines or other weakening means could run in different directions to achieve the desired shape without departing from the spirit and scope of the present invention. Therefore, it will be appreciated by those skilled in the art that the present packaging container can be produced in a wide variety of different shapes suitable and adaptable to accommodate an equally wide variety of products to be house therewith in.

Figure 4:
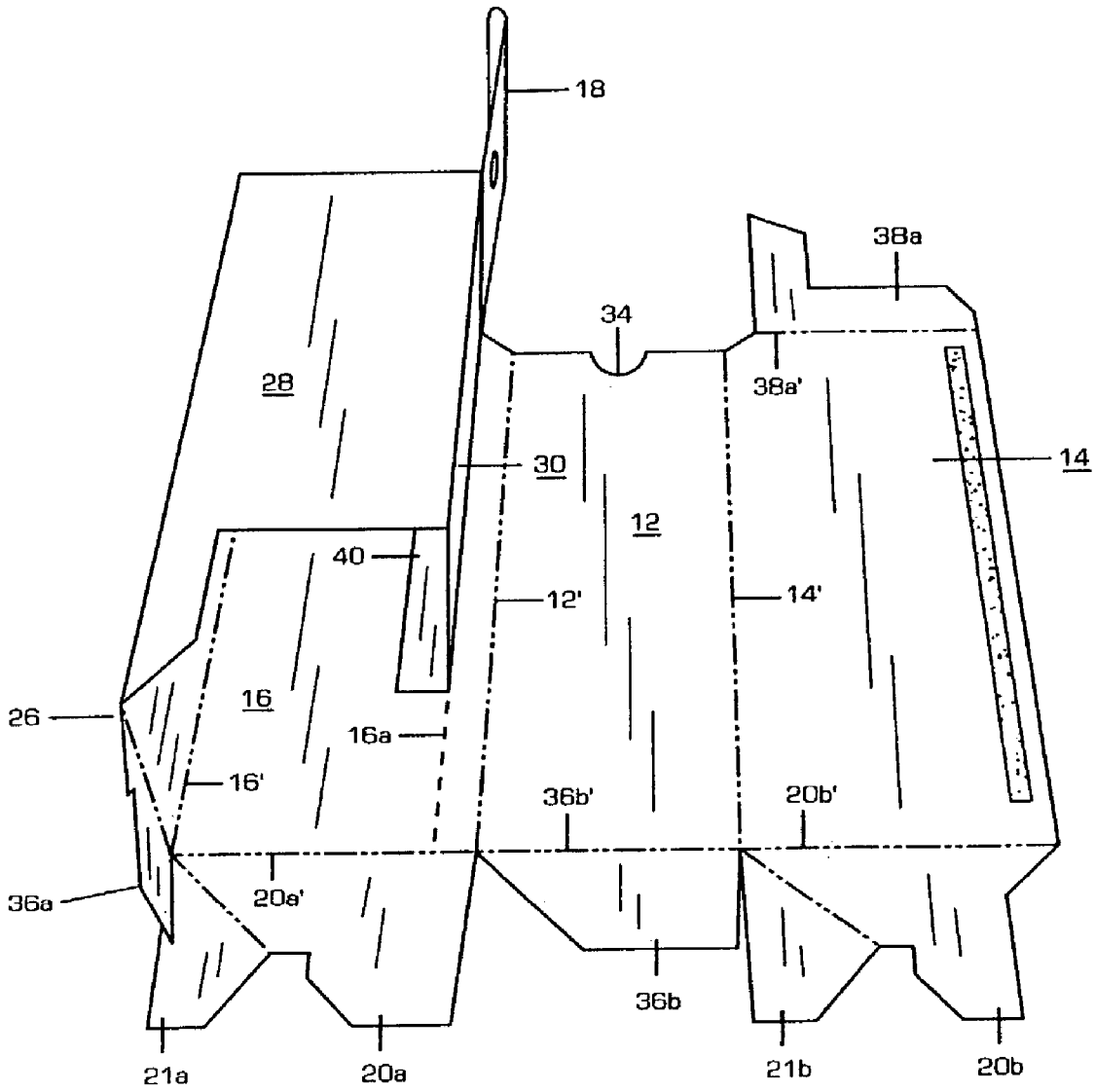
FIG. 4 is a perspective view showing a first group of panels associated with the sheet of material illustrated in FIG. 3 folded to form the interior space of the container embodiment illustrated in FIGS. 1 and 2.
Figure 5:
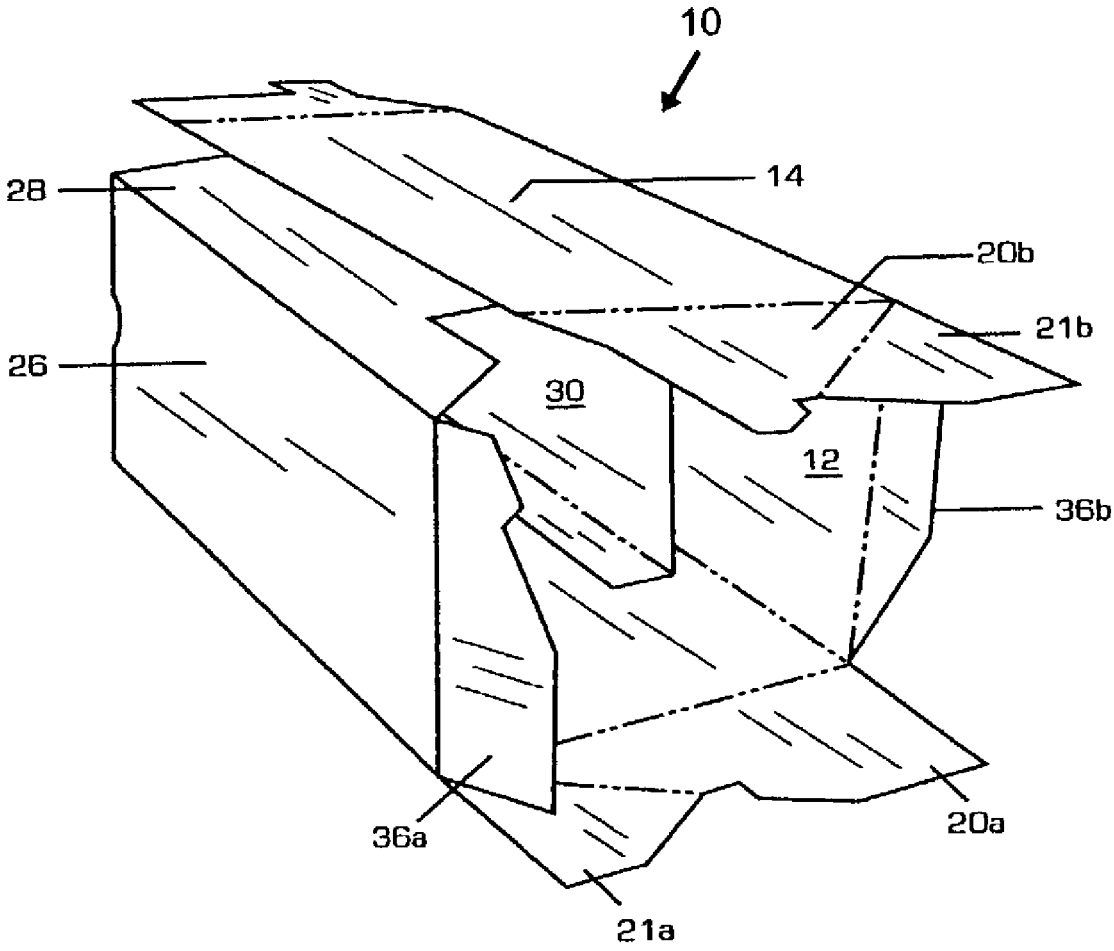
FIG. 5 is a perspective view showing a second group of panels associated with the sheet of material illustrated in FIGS. 3 and 4 folded almost to its final position to complete the forming of the container pocket.

Referring to FIGS. 3–5 will serve to illustrate the ease with which one embodiment of the container 10 of the present invention can be folded into its assembled configuration. In FIG. 3, there is shown a plan view of the flat sheet of material which comprises the assembled container 10. In its flat form as illustrated in FIG. 3, unassembled containers 10 can be easily and conveniently stored and/or shipped for future assembly and use. Storing and transporting assembled containers of any type can often be bulky and can lead to shipping difficulties in that such containers take up valuable space. If desirable, unassembled containers 10 in their substantially flat form can be easily transported from one location to another prior to usage, or such unassembled containers can be easily stored in a minimum of space prior to assembly and use. To assemble the present container, the flat sheet of material 10 is first folded along lines 16', 26', 28' and 30' as best illustrated in FIG. 4 so as to form a box-like structure with tab 40 being positioned and located against the interior portion of panel 16. In this regard, the overall width of panel 16 is greater than the width of panels 26, 28 and 30 and tab 40 is positioned adjacent panel 16 as illustrated in FIG. 4 such that fold line 30' is positioned in substantial alignment along the dashed-line 16*a*. As will be hereinafter apparent, the portion of panel 16 which lies between tab 40 and fold line 12' (FIG. 4) will define one of the opposed side wall portions forming the pocket 22 when panels 12 and 14 are subsequently folded in overlapping relationship to the box-like structure formed in FIG. 4. Once tab 40 is positioned as illustrated in FIG. 4 adjacent panel 16 and dashed-line 16*a*, tab 40 is attached to panel 16 by any suitable means such as via a suitable adhesive. The box-like structure illustrated in FIG. 4 defines the interior storage space of assembled container 10. A suitable adhesive can be placed along the interior portion of panel 16 adjacent dashed-line 16*a* as indicated by the adhesive strip 44 illustrated in FIG. 3. Once panels 26, 28 and 30 are folded as previously indicated, the inner portion of panel 16 having the adhesive associated therewith will engage the outer surface of tab 40 at points indicated by a dashed "X" completing the engagement therebetween. As can be seen from viewing both FIGS. 3 and 4, tab 40 does not extend along the full length of panel 16 adjacent dashed-line 16*a*. In fact, the longitudinal length of tab 40 may be varied depending upon the type of product to be stored within container 10 and the amount of stability and rigidity desired.

Once tab 40 is suitably attached to panel 16 as previously indicated, the flat sheet of material is folded along fold lines 12' and 14', panel 14 being of the same width as panel 16 and being of a greater width than panel 12. As illustrated in FIG. 5, when panels 12 and 14 are folded such that panel 14 is positioned in an overlapping relationship to panel 28, the pocket or cavity 22 as best illustrated in FIGS. 1 and 2 is formed. Panel 14 is suitably attached to panel 28 using any suitable attachment means such as via a suitable adhesive. In this regard, as with panels 16 and tab 40, a suitable adhesive is placed along the interior edge portion of panel 14 as indicated by the adhesive strip 46 (FIG. 3) and such portion of panel 14, when folded as illustrated in FIG. 5, will overlay and engage the outer surface of panel 28 at points indicated by a dashed X. At this point in the assembly of container 10, the pocket or cavity 22 is formed due to the positioning of tab 40 with respect to panel 16 and due to the greater width associated with panels 14 and 16. More particularly, pocket or cavity 22 is formed between the outer surface of panel 30, the inner surface of panel 12, and opposed side portions of panels 14 and 16. At this point during the assembly of container 10, the box-like structure so formed remains open at both opposite ends thereof with top panel 18 and flaps 36*a*, 36*b*, 38*a*, 38*b*, 20*a* and 20*b* protruding therefrom.

To continue the assembly process, flaps 38*a* and 38*b* are folded down and top panel 18 is folded across the top of flaps 38*a* and 38*b*. Tab 42 secures top panel 18 in place by inserting tab 42 within the interior space of container 10 adjacent rear panel 26. Flaps 38*a* and 38*b* only partially enclose the interior space of container 10 thereby allowing a scented product such as a candle to be at least partially exposed under top panel 18 to allow the fragrance associated therewith to escape through the opening 24 in top panel 18 for smelling by a potential consumer. In this regard, the opening 24 can take on any shape other than the circular shape illustrated in FIGS. 2–5. Also, in those embodiments where no scented products are housed within container 10, the opening 24 may be eliminated from top panel 18. Bottom flaps 36*a* and 36*b* are also folded inward and flaps 20*a* and 20*b* are folded down on top of flaps 36*a* and 36*b*, with protrusions 21*a* and 21*b* interlocking to secure the bottom of the container. A suitable adhesive may be placed along the underside of protrusions 21*a* and 21*b* thereby fixedly attaching such protrusions to flaps 36*a* and 36*b*, if so desired. Flaps 36*a* and 36*b* add strength and rigidity to the bottom panel 28.

Once assembled, an embodiment of the present invention takes on the form illustrated in FIG. 1. In this regard, it should be noted that side panels 14 and 16, and rear panel 26 extend longitudinally along the height of the container 10 between the top and bottom panel portions 18 and 20 whereas interior or intermediate panel 30 which forms one of the side walls defining the interior space of container 10 extends longitudinally along only a portion of the height of container 10 between the top and bottom panels 18 and 20. As best seen in FIGS. 3–5, interior side panel 28 likewise extends only partially along the full height of container 10 between the top and bottom panels 18 and 20. Although front panel 12 is illustrated in FIG. 1 as likewise extending longitudinally along substantially the entire height of container 10, but not all the way to the top edge portion of top panel 18, it is recognized and anticipated that the front panel 12 may extend longitudinally along any portion of the height of the container 10 depending upon the type of promotional literature or other materials to be inserted within pocket 22, or front panel 12 could extend along the entire height of container 10. Still further, it is important to note that since panels 14 and 16 are greater in width as compared to other panels which form the interior space of container 10, side panels 14 and 16 likewise extend laterally beyond the front edge portion of the top panel 18 as best illustrated in FIGS. 1 and 2 and it is this extension of side panels 14 and 16 in conjunction with front panel 12 and intermediate panel 30 which forms the pocket 22 therebetween. In other words, the side panels 14 and 16 extend beyond the perimeter of the top panel 18 on at least one side thereof when the top panel 18 is moved to its closed position as best illustrated in FIGS. 1 and 2. In this regard, top panel 18 is pivotally connected to the upper edge portion of intermediate panel 30 along the fold line 18' as best illustrated in FIGS. 1 and 3.

The embodiment of the present container illustrated in FIGS. 1–6 is primarily designed to be used for marketing scented products such as candles and the like. A candle having roughly the same shape as the interior of container 10 is inserted therewithin. Preferably, the wick of the candle extends through opening 24. Opening 24 allows a potential purchaser to smell the candle without opening container 10. Promotional literature in the form of a folded insert, ring-bound cards, or other suitable format is inserted into pocket 22. A potential purchaser in a retail setting can remove the literature and read it without opening container 10. The cutout 34 in panel 12 is provided to allow the user to easily slide the literature out of pocket 22.

Although a preferred embodiment of the present container 10 is constructed from heavy paper or cardboard, it is contemplated that the container may be constructed from any suitable material including, for example, any suitable lightweight flexible board type materials and various plastics. Suitable plastic board or sheet material may be made from any polymers which would demonstrate the requisite flexibility for folding or bending along score lines or other weakening means and the needed strength and stiffness for the particular container application. Further, although the preferred embodiment is held together by applying a suitable adhesive in the places indicated above, it is contemplated that any other suitable means of holding the container in its desired shape may be utilized.

Thus, there has been shown and described several embodiments of a packaging container, which embodiments fulfill all of the objects and advantages sought therefor. Many changes, modifications, variations and other uses and applications of the present packaging container will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A container having an interior space for holding a product therewithin comprising:

top, bottom, front, intermediate, rear and side panels, said top panel having a front edge portion;

said intermediate panel being positioned between said front and rear panels and extending longitudinally along only a portion of the height of said container from the front edge portion of said top panel;

at least two side panels extending longitudinally along the height of said container between said top and bottom panels and substantially the full height of said at least two side panels extending laterally beyond the front edge portion of said top panel thereby forming a pocket between said front panel and said intermediate panel, said pocket extending longitudinally along substantially the full height of said container between said top and bottom panels and including a space adaptable for holding informational literature relating to a product positioned within said container;

said intermediate and rear panels and portions of said at least two side panels defining the interior space of said container for holding a product therewithin, a portion of said interior space communicating with said pocket space;

said top panel extending between said intermediate panel, said rear panel, and portions of said at least two side panels and including an opening for allowing a person to smell the scent associated with a product positioned within said interior space said top panel being pivotally moveable about its front edge portion and opening adjacent said rear panel.

2. A container having an interior space for holding a product therewithin comprising a single sheet of material having a plurality of fold lines located at various locations thereon defining a plurality of panels therebetween, said sheet of material being foldable along each respective fold line for forming said container, some of said plurality of panels including bendable flaps, some of said bendable flaps forming the bottom panel of said container, some of said flaps partially covering the interior space adjacent the top portion of said container, said plurality of panels being dimensioned such that a first group of said plurality of panels are first foldable to form the interior space of said container, and a second group of said plurality of panels are thereafter foldable relative to said first group to form a pocket extending longitudinally along substantially the full height of said container for holding product literature such that a portion of the interior space of said container communicates with the space formed within said pocket, said plurality of foldable panels, when folded, further defining front, rear, intermediate and side panels, said intermediate panel having an upper edge portion and extending along only a portion of the height of the container from said upper edge portion, one of said plurality of panels forming a top panel of said container, said top panel including an opening for allowing a person to smell the scent associated with a product positioned within said interior space and overlaying the flaps partially covering said interior space adjacent the top portion of said container, said flaps partially covering said interior space not interferring with said top panel opening, said top panel extending between said intermediate and rear panels and between portions of said side panels and being pivotally movable between an open position providing access to the interior space of said container and a closed position denying access thereto, said top panel being pivotally movable about the upper edge portion of said intermediate panel so as to open adjacent said rear panel.

* * * * *

UNITED STATES PATENT AND TRADEMARK OFFICE

CERTIFICATE OF CORRECTION

PATENT NO. : 6,971,511 B2
DATED : December 6, 2005
INVENTOR(S) : David L. Holmon It is certified that error appears in the above-identified patent and that said Letters Patent is hereby corrected as shown below:

Title page,
Item [54], Title, delete "PACKAGING CONTAINER FOR CANDLES AND INFORMATIONAL LITERATURE" and replace with -- PACKAGING CONTAINER FOR CANDLES AND THE LIKE --.

Column 4,
Line 33, delete "therewith in" and replace with -- therewithin --.

Column 8,
Line 24, delete "interferring" and replace with -- interfering --.

Signed and Sealed this

Twenty-first Day of March, 2006

JON W. DUDAS
*Director of the United States Patent and Trademark Office*